United States Patent [19]

Pachel et al.

[11] Patent Number: 4,481,711

[45] Date of Patent: Nov. 13, 1984

[54] DRY-SHAVING APPARATUS AND HEAD-MEMBER UNIT FOR SAID APPARATUS

[75] Inventors: Max Pachel; Norbert Schneider, both of Klagenfurt, Austria

[73] Assignee: U.S. Philips Corporation, New York, N.Y.

[21] Appl. No.: 427,403

[22] Filed: Sep. 29, 1982

[30] Foreign Application Priority Data

Oct. 9, 1981 [AT] Austria ..... 4360/81

[51] Int. Cl.[3] ..... B26B 19/10

[52] U.S. Cl. ..... 30/34.1

[58] Field of Search ..... 30/34.1, 43.92, 346.51

[56] References Cited

U.S. PATENT DOCUMENTS 3,704,518 12/1972 Heyek ..... 30/34.1

3,729,821 5/1973 Voigt ..... 30/34.1

*Primary Examiner*—Jimmy C. Peters

*Attorney, Agent, or Firm*—Rolf E. Schneider

[57] ABSTRACT

A dry-shaving apparatus comprises a shear-shaving section having a first head member formed by an arcuate flexible shear foil providing a working surface, such shear-shaving section including a plurality of reciprocatingly drivable cutters co-operating with the flexible shear foil. Included is a comb-shaving section having a second head member constructed as a rigid trough-shaped part fixedly and permanently connected to the flexible shear foil and provided with a working surface, such comb-shaving section including a reciprocatingly drivable rigid cutter co-operating with the rigid trough-shaped part. The first head member and the second head member together constitute a head-member unit. A cutter unit co-operates with the head-member unit and includes a reciprocatingly drivable support for supporting and driving the cutters of the respective shaving sections. The working surface of the comb-shaving section adjoins the working surface of the shear-shaving section and projects laterally therefrom, the plane defined by the working surface of the comb-shaving section forming an obtuse angle with the plane tangent to the working surface of the shear-shaving section at the location where the two shaving sections adjoin each other. The rigid cutter of the comb-shaving section is supported by the cutter unit support by means of at least one spring.

8 Claims, 4 Drawing Figures

DRY-SHAVING APPARATUS AND HEAD-MEMBER UNIT FOR SAID APPARATUS

This invention relates to a dry-shaving apparatus which comprises at least one shear-shaving section and at least one comb-shaving section, in which the head member of the shear-shaving section, which head member includes an arcuate flexible shear foil, and the head member of the comb-shaving section form a head-member unit, a working surface of the comb-shaving section adjoining the working surface of the shear-shaving section lengthwise, and a cutter unit which co-operates with said head-member unit and which includes a reciprocatingly drivable support for supporting and driving the cutters of the shaving sections.

Such a dry-shaving apparatus is known from U.S. Pat. No. 3,704,518. This known dry-shaving apparatus comprises one shear-shaving section and two comb-shaving sections, the working surfaces of the comb-shaving sections each directly adjoining one of the two long sides of the working surface of the shear-shaving section and following its curvature. The head-member unit is made in one piece and is constituted by a single metal foil whose central portion is formed with a pattern of apertures and constitutes the head member for the shear-shaving section and whose long edge portions are inclined and are formed with shaving-comb slits, which portions constitute the head members for the two comb-shaving sections. The two cutters of the comb-shaving sections are comprised of a metal foil, whose inclined edge portions are each provided with a row of slits to form the shaving-comb cutters, which co-operate with the shaving-comb slits in the shear foil. It has been found that comb-shaving sections of this construction do not provide a satisfactory cutting action for longer hairs, because the metal foils forming the head members and the cutters are not rigid enough. In contradistinction to the shear-shaving section in which especially for the head member a shear foil has proved to perform satisfactorily the flexibility of the shear foil guarantees a snug engagement with the cutter. It is also found that by manufacturing the cutters of the comb-shaving sections from a flexible metal foil the engagement of said cutters with the associated head members is inadequate to provide an appropriate cutting pressure, which also reduces the cutting action. Since in said dry-shaving apparatus the comb-shaving sections are disposed at the location of the inclined long edge portions of the shear foil, the working surfaces of the comb-shaving sections directly adjoin the working surface of the shear section but follow the curvature of the shear-shaving foil, so that the two different shaving systems, namely the shear-shaving system and one of the two comb-shaving systems, cannot be used simultaneously because the dry-shaving apparatus should be in a certain inclined position in order to use one of the two comb-shaving sections. However, for a higher shaving efficiency it is found to be advantageous if such different shaving systems can be used simultaneously, because this permits longer and shorter hairs to be cut at the same time.

It is an object of the present invention to construct a dry-shaving apparatus of the indicated type comprising two shaving systems in such a way that each shaving system can be dimensioned in an optimum manner and both shaving systems can be used simultaneously utilizing substantially their entire effective shaving areas, whilst moreover the construction, manufacture and assembly of the shaving systems are made very simple. To this end the invention is characterized by the following combination of features, namely (a) the head member of the comb-shaving section is constructed as a trough-shaped inherently rigid part which is fixedly and permanently connected to the shear foil, (b) the working surface of the comb-shaving section adjoins the working surface of the shear-shaving section and projects laterally outwardly therefrom, the plane defined by said working surface of the comb-shaving section forming an obtuse angle with the plane which is tangent to the working surface of the shear-shaving section at the location where the two shaving sections adjoin each other, and (c) the inherently rigid cutter of the comb-shaving section is supported by the support of the cutter unit via at least one spring.

By combining these three characteristic features the head member and the cutter of a comb-shaving section can each be made rigid and can be urged against each other by a separate spring, so that such a comb-shaving section has satisfactory cutting properties for longer hairs. Moreover, the comb-shaving section can be arranged in such a way relative to the shear-shaving section that their working surfaces adjoin each other which permits both shaving systems to be used simultaneously, which by the simultaneous cutting of longer and shorter hairs reduces the shaving time and thereby increases the shaving efficiency.

It is to be noted that characteristic feature (a) is known per se from German Pat. No. 938,475, but there the complete comb-shaving sections each adjoin the working surface of the shear foil and project laterally at substantially right angles so that the working surfaces of these comb-shaving sections are disposed in planes which extend substantially parallel to the relevant plane which is tangent to the working surface of the shear-shaving section at the location where the shaving sections adjoin each other, as a result of which the two shaving systems cannot be used simultaneously in an appropriate manner. Furthermore, characteristic feature (b) is known per se from German Pat. No. 1,553,713, but there the two shaving systems are constructed in separate parts which results in an intricate overall construction. Finally characteristic feature (c) is known per se from British Pat. No. 628,599, in accordance with which only a plurality of comb-shaving sections is provided. However, it is the very combination of these three different characteristic features which, when applied to a dry-shaving apparatus of the instant type, provides all the advantages set forth above.

In order to permanently connect the head member of the comb-shaving section to the shear foil there may be provided an angular strip, for example on a side wall of the trough-shaped part, to which the shear foil is attached by means of its edge portion. However, in this respect it is found to be very advantageous if the head member of the shear-shaving section is connected directly and permanently to a side wall of the trough-shaped part by a longitudinal edge portion of the shear foil which is inclined towards the cutter unit. In this way the transition between the working surface of the shear-shaving section and the working surface of the comb-shaving section can be restricted to a comparatively small area, which is very favourable for the simultaneous use of both shaving systems.

In this respect it is also found to be advantageous if the inclined edge portion of the shear foil which is connected to the side wall of the trough-shaped part extends near an inclined portion formed on the cutter of the shear-shaped section. This enables the transition between the working surface of the shear-shaving section and the working surface of the comb-shaving section to be restricted to an even smaller area.

At the location of the inclined edge portion of the shear foil which is connected to the side wall of the trought-shaped part the head-member unit may be entirely clear of the cutter unit. However, it is also found to be advantageous if the cutter unit includes a guide surface which co-operates with the head-member unit at the location of the inclined edge portion of the shear foil, which portion is connected to the side wall of the trough-shaped part. This provides a sliding co-operation between said portion of the head-member unit and the guide surface on the cutter unit when the cutter unit is driven, which results in a very effective guidance of the cutters in the immediate vicinity of the head-member unit, thereby promoting the shaving action of the shaving sections.

In this respect it is also found to be advantageous if the slits formed as hair-entry apertures in the head member of the comb-shaving section continue in that side wall of the trough-shaped part of the head member of the comb-shaving section which is remote from the shear foil. Thus, as is known per se, a comb with long hair-entry apertures is formed, which is beneficial for catching longer hairs.

In this respect it is also found to be advantageous if consecutively at least two adjacent slits form one continuous aperture in the side wall. This enlarges the hair-entry apertures in the side wall, which promotes the catching of longer hairs whilst moreover, as a result of the continuous bridges which are left the comb action is preserved and appropriate stability of the head member of the comb-shaving section is guaranteed.

In a dry-shaving apparatus in which the head-member unit has mounting apertures at the location of both its longitudinal edge portions, by means of which apertures said unit is mounted on projecting lugs on a supporting member of the dry-shaving apparatus, it is found to be advantageous if that side wall of the trough-shaped part of the head member of the comb-shaving section which is remote from the shear foil adjoins an edge portion which is inclined relative to the side wall, which has at least one mounting aperture and which is disposed substantially in the imaginary extension of the arcuate shear foil. If the head-member unit is thus attached to a supporting member of the dry-shaving apparatus a uniform and smooth adjustment of the head-member unit under the influence of the shaving pressure acting on it is guaranteed, which is important in order to ensure a correct co-operation with the cutters.

In a dry-shaving apparatus in which the cutter of the shear-shaving section is stationarily arranged on the support of the cutter unit and the support is urged towards the head-member unit by means of at least one spring, it is also found to be advantageous if a working surface of only one comb-shaving section directly adjoins the working surface of the shear-shaving section and, in order to balance all forces and moments, the direction of the force exerted on the support of the cutter unit by the spring is such that it extends between the longitudinal plane of symmetry of the shear-shaving section and the longitudinal plane of symmetry of the comb-shaving section. This yields several advantages. The known stationary arrangement of the cutter of the shear-shaving section on the support of the cutter unit, said cutter being urged towards the head-member unit by means of a spring in order to guarantee a correct co-operation between the head member and the cutters, results in a very simple construction for the cutter unit. As a result of the further feature, known per se, of combining only one comb-shaving section with the shear-shaving section the two shaving sections are so arranged that the user of such a dry-shaving apparatus can conveniently employ both shaving systems at the same time. Finally, as a result of the special arrangement of the spring which acts on the support of the cutter unit the co-operation of the cutter unit with the head-member unit meets the well-known stability requirement that the sum of all forces and the sum of all moments should be zero, so that no additional frictional forces occur at the abutments, which of course is favourable in general and in particular for overall shaving performance.

Furthermore, the invention relates to a head-member unit for a dry-shaving apparatus in accordance with the invention. Such a head-member unit is characterized in that the shear foil which constitutes the head member for the shear-shaving section includes an inclined edge portion at the location of at least one of its two longitudinal edges, a side wall of a trough-shaped inherently rigid part which forms the head member for a comb-shaving section being rigidly connected to said inclined edge portion. This results in a unit of simple construction which is easy to manufacture, which is just as easy to handle as a shear foil alone, so that such a head-member unit is particularly suitable as a spare part. The combined head members of the shear-shaving section and the comb-shaving section may then be constructed so that they have optimum properties for the relevant shaving system. Furthermore, the connection of an inclined edge portion of the shear foil directly to a side wall of the trough-shaped part ensures that the working surfaces of the head members adjoin each other very closely, so that a maximum area remains available for shaving purposes. The inclined edge portion of the shear foil may be connected to the side wall of the trough-shaped part in various manners, for example by welding, rivetting or clamping.

The invention will now be described in more detail with reference to the accompanying drawings, in which.

Figure 1:
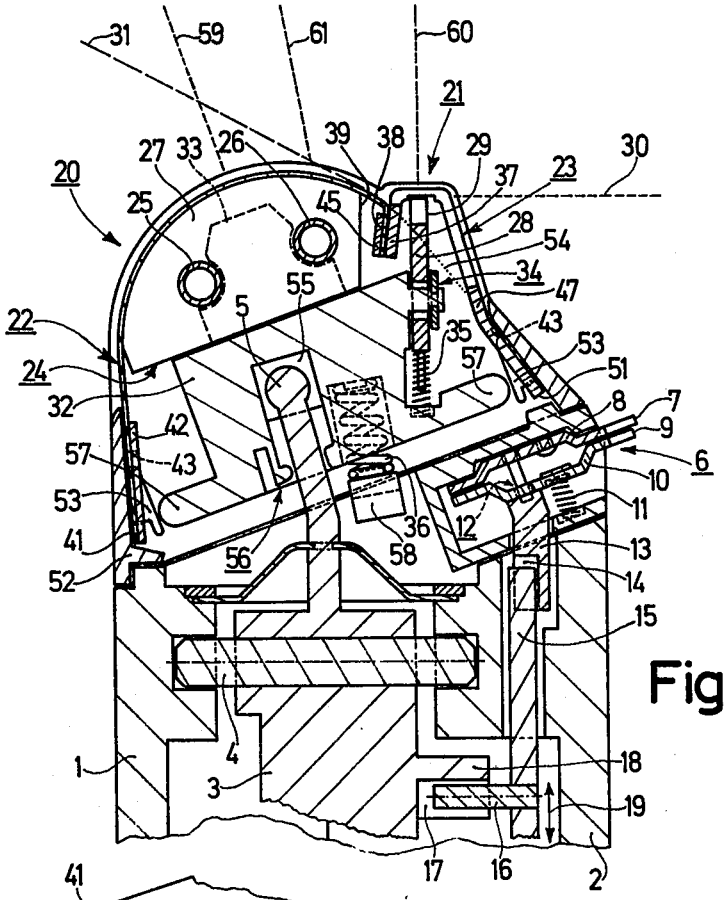
FIG. 1 shows the relevant parts of a dry-shaving apparatus which comprises a shear-shaving section and, adjacent one of its long sides, a comb-shaving section in a sectional view taken transversely of the reciprocating motion with which the cutter unit is driven.
Figure 4:
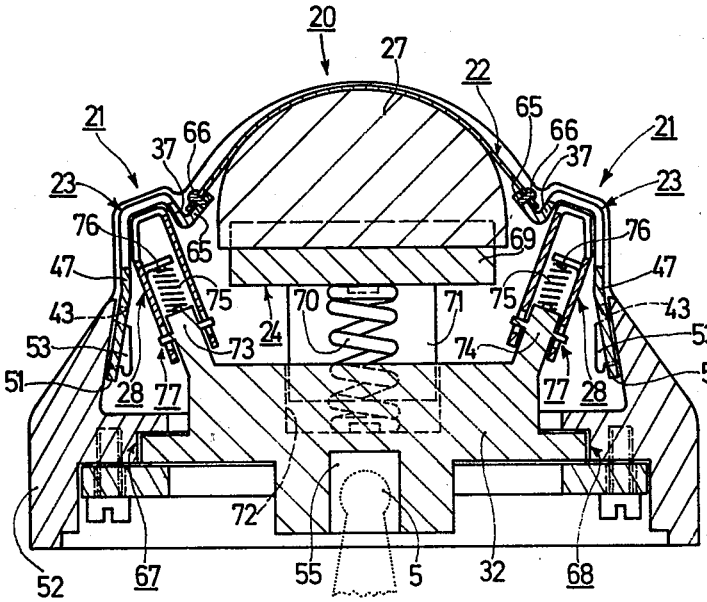

FIG. 4, in the same way as FIG. 1, shows a dry-shaving apparatus comprising a shear-shaving section and two comb-shaving sections which each adjoin a long side of the shear-shaving section.

In FIG. 1 a first housing section of a dry-shaving apparatus is designated 1 and a second housing section is designated 2, which housing sections accommodate the drive mechanism of the dry-shaving apparatus. Of this drive mechanism only the swing lever 3 is shown, which is pivotally mounted on a shaft 4 arranged between the housing sections 1 and 2. This swing lever 3 may, for example, form part of an oscillating armature motor or may be reciprocated by an eccentric mounted on a rotary motor shaft. The swing lever 3 has a free end 5, which produces the reciprocating drive motion.

Also mounted on the housing section 2 is a unit 6 which forms a long-hair trimmer. Such trimmer comprises a stationary plate-shaped upper member 8 having teeth 7 along one edge and a similarly arranged reciprocatingly drivable plate-shaped cutter 10 having cutting teeth 9 along one edge. The cutter 10 is urged against the upper member 8 by means of two springs, of which one spring 11 is shown in FIG. 1, and is reciprocatingly guided via pin-slot connections 12. For driving the cutter 10 there is provided a coupling arm 13, whose free end is formed with a slot 14 in which a further swing lever 15 engages, which lever has a projection 16 which engages a slot 17 in a coupling projection 18 on the swing lever 3. In this way the reciprocatory movement of the swing lever 3 is transmitted to the cutter 10 via the further swing lever 15. The further swing lever 15 is, for example, pivotally mounted on the housing section 2 and is also movable in its longitudinal direction (which is not shown in more detail), so that by moving the swing lever 15 in the direction of the double arrow 19, which is possible by means of a suitable actuating member, the drive connection between the cutter 10 and the swing lever 3 can be eliminated, or established as shown in FIG. 1.

This long hair trimmer 6 is an additional cutting element, as frequently used in dry-shavers which serves, for example, for trimming side burns. In the present embodiment the shaving head of the dry-shaving apparatus comprises the shear-shaving section 20 and the comb-shaving section 21 arranged adjacent a long side of said shear-shaving section, the shear section serving for cutting shorter hairs and the comb-shaving section for cutting longer hairs.

The head member of the shear-shaving section comprises a comparatively thin, arcuate and flexible shear foil 22, in whose working surface a pattern of hair-entry apertures is formed, and the head member of the comb-shaving section comprises a trough-shaped inherently rigid part 23, in whose working surface hair-entry apertures in the form of slits are formed and which is made of a slightly thicker material so as to provide the required rigidity in so far that this is not provided by its construction.

These head members co-operate with reciprocatingly drivable cutters. The cutter 24 which co-operates with the shear foil 22 is arcuate and in the present embodiment it comprises a so-called tube-and-lamella cutter. For this purpose a row of cutter lamellae 27 is arranged, spaced from each other, on two tubes 25 and 26. It is evident that such a cutter may be of any other known construction, for example, a shear foil which is clamped in position to obtain its arcuate form. The cutter 28 of the comb-shaving section 21 is also inherently rigid and in the present case comprises a plate-shaped part which is formed with cutting teeth 29 along one longitudinal edge. The free ends of the cutting teeth co-operate with the trough-shaped part 23 forming the head member of the comb-shaving section, specifically with that portion formed with the hair-entry apertures. Obviously, other cutter constructions may be used such as an angular section or a T-section.

In this way both shaving systems, namely the shear-shaving section and the comb-shaving section, can each be dimensioned in an optimum manner, thereby providing a satisfactory cutting action both for shorter and longer hairs. Moreover, it is found to be advantageous if these two shaving systems are arranged so that they can be used simultaneously, so that during shaving both longer and shorter hairs can be cut, thus providing a close shave within a shorter time. For this purpose a working surface of the comb-shaving section 21 directly adjoins the working surface of the shear-shaving section 20 along a long side, namely in such a way that this working surface of the comb-shaving section projects laterally and that at the location where the two shaving sections 20, 21 adjoin each other the plane defined by said working surface of the comb-shaving section 21 forms an obtuse angle with the plane which is tangent to the working surface of the shear-shaving section 20, as can be seen in FIG. 1. For the sake of clarity said planes are represented by broken lines in FIG. 1, the line 30 denoting the plane defined by the working surface of the comb-shaving section 21 and the line 31 denoting the plane which is tangent to the working surface of the shear-shaving section 20 at the location where the two shaving sections adjoin each other. The magnitude of the obtuse angle between the two planes 30 and 31 depends entirely on the requirement that the two shaving systems should be usable simultaneously with an optimum use of their working surfaces, a decisive criterion being the degree of curvature of the shear section 20, i.e. its pitch. When the curvature of the shear section is very shallow the obtuse angle will be comparatively near to 180°, whilst in the case of a pronounced curvature of the shear section it will be substantially smaller.

For effective use of both shaving systems at the same time it is also important that the working surface of the comb-shaving section 21 is situated as closely as possible to the working surface of the shear-shaving section 20. In order to meet this requirement the trough shaped part 23 forming the head member of the comb-shaving section 21 is rigidly and permanently connected to the shear foil 22 forming the head member of the shear-shaving section 20, so that the two head members form a head-member unit. In the same way the two cutters 24 and 28 of the two shaving sections 20, 21 are also combined to form a cutter unit, for which purpose there is provided the reciprocatingly drivable support 32, which supports and drives the two cutters 24 and 28. The cutter 24 of the shear-shaving section 20 is stationarily mounted on the support 32, for which purpose its two tubes 25 and 26 are, for example, snapped onto lugs 33 which project from the support 32 and which extend between the cutter lamellae 27. The cutter 28 of the comb-shaving section 21, however, is arranged so as to be slidable towards the trough-shaped part 23 forming the head member via a pin-slot connection 34 and is supported on the support 32 via two springs, of which spring 35 is visible in FIG. 1, so that it is urged into the trough-shaped part 23 by these springs. This ensures a correct co-operation of the cutter 28 with the head member of the comb-shaving section 21 formed by the trough-shaped part 23, such that the appropriate shaving pressure is maintained. Since the cutter 24 of the shear-shaving section 20 should also resiliently co-operate with the shear foil 22, two springs co-operate with the support 32 of the cutter unit, of which spring 36 is visible in FIG. 1, which springs urge it towards the head-member unit, as will be described in more detail hereinafter.

In order to ensure that the two working surfaces of the two shaving sections 20, 21 adjoin each other as closely as possible for optimum simultaneous use, one of the two side walls, in the present case the side wall 37, of the trough-shaped part 23 forming the head member of the comb-shaving section 21 is connected directly and permanently to a longitudinal edge portion 38 of the shear foil 22, which is inclined inwardly towards the cutter unit 24, 28, 32. Moreover, that edge portion 38 of the shear foil 22 which is connected to the side wall 37 of the trough-shaped part 23 is disposed near, and in the present example clear of, a similarly inclined portion 39 formed on the cutter 24 of the shear-shaving section.

Figure 2:
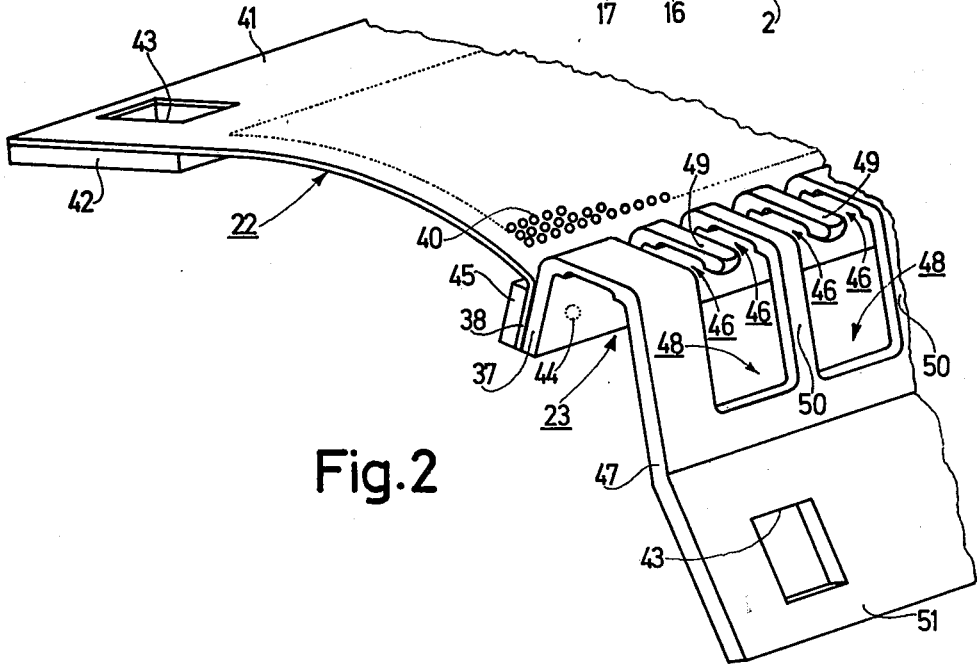
FIG. 2 is a perspective view on an enlarged scale of the head-member unit shown in FIG. 1.

A shaving head unit 22, 23 as described above is shown separately in FIG. 2. A pattern 40 of hair-entry apertures in the shear foil 22 forms the working surface, next to which the inclined longitudinal edge portion 38 is disposed. The opposite longitudinal edge portion 41 of the shear foil 22 adjacent the pattern 40 is provided with a reinforcement strip 42 and is formed with mounting holes 43 which also extend through the reinforcement strip 42. The head member of the comb-shaving section 21 is formed by the trough-shaped part 23, whose side wall 37 is connected directly and permanently to the edge portion 38 of the shear foil 22. Such connection can be made in several ways using the customary techniques. In the present embodiment spot-welding is used, one of the spot-welds being schematically represented by 44 in FIG. 2. Since the shear foil 22 consists of a very thin material, a further reinforcement strip 45 is arranged along the edge portion 38 of the shear foil 22 at the side which is remote from the side wall 37 of the trough-shaped part 23, so that a very stable spot-welded connection is obtained. The head member of the comb-shaving section 21 formed by the trough-shaped part 23 is formed with slits 46 in its working surface, which slits serve as hair-entry apertures. As can be seen, these slits 46 almost directly adjoin the aperture pattern 40 in the shear foil 22, so that with such a head-member unit 22, 23 the two shaving systems 20, 21 may be used simultaneously in a particularly effective manner.

In the present embodiment the slits 46 formed as hair-entry apertures in the head member of the comb-shaving section 21 extend into the side wall 47 of the trough-shaped part 23 which is remote from the shear foil 22, every two adjacent slits 46 forming one continuous aperture 48 in the side wall 47. Thus, in the working surface of the trough-shaped part 23 forming the head member of the comb-shaving portion freely projecting teeth 49 alternate with continuous bridges 50. By means of such a head member for the comb-shaving section 21 longer hairs are caught effectively and are led to the working surface of the comb-shaving section 21 where the head member and the cutter co-operate with each other in order to sever these hairs. The bridges 50 between the apertures 48 then act like a comb, which aligns the longer hairs and leads them to the apertures 48 or slits 46. Moreover, these bridges 50 provide a suitable stability for trough-shaped part 23. Obviously, such a continuous aperture 48 may also be formed by more than two slits 46.

In addition, an edge portion 51 which is inclined relative to the side wall 47 and which in the same way as the edge portion 41 of the shear foil 22 has mounting apertures 43, adjoins said side wall 47 of the trough-shaped part 23 forming the head member of the comb-shaving portion 21. Such head-member unit 22, 23 is just as easy to handle as a shear foil alone, so that it is also suitable as a spare part. In the present embodiment, as can be seen in FIG. 1, a shaving-head frame 52 is provided for mounting the head-member unit 22, 23 on the dry-shaving apparatus, which frame can be mounted on the assembled housing sections 1 and 2 and whose two longitudinal members include projecting lugs 53, into which the head-member unit 22, 23 can be mounted by means of its mounting apertures 43. Moreover, the edge portion 51, which adjoins the side wall 47 of the trough-shaped part 23 forming the head member of the comb-shaving section 21 and which is formed with the mounting apertures 43, is inclined so that it is disposed in the imaginary extension of the arcuate shear foil 22, as is indicated by the broken line 54. This provides a uniform and reliable adjustment for the entire head-member unit 22, 23 relative to the shaving-head frame 52 in response to the shaving pressure acting on it, which is essential for a correct co-operation with the cutters 24, 28.

For its reciprocating drive the cutter unit comprising the support 32 and the cutters 24 and 28 is coupled to the free end 5 of the swing lever 3, for which purpose this free end 5 engages a slot-like recess 55 in the support 32. A snap connection 56 ensures, in known manner, that the cutter unit 24, 28, 32 is retained on the free end 5 of the swing lever 3. Two ridges 57, which project laterally from the support 32 and which co-operate in a sliding fashion with the projections 53 on the shaving-head frame 52 when the cutter unit 24, 28, 32 is driven, form a rectilinear guide for this unit. As already stated, the support 32 is urged towards the head-member unit 22, 23 by means of springs 36. These springs 36 act on the support 32 and on abutments 58 on the housing section 2. It is obvious that these springs 36 should be dimensioned in conformity with the dimensioning of the springs 35 which act between the support 32 and the cutter 28 of the comb-shaving section 21. Furthermore, it is thus ensured that the entire system is in a stable condition, such that no additional frictional forces occur at the abutments, for which as is known the sum of all forces and the sum of all moments should be zero. In the present embodiment this is achieved in that the direction of the force of the springs 36 which act on the support 32 of the cutter unit 24, 28, 32 extends between the longitudinal plane of symmetry of the shear-shaving section 22 and the longitudinal plane of symmetry of the comb-shaving section 21 for which purpose the springs 36 are arranged in a suitable oblique position. In FIG. 1 these two longitudinal planes of symmetry are represented by the broken lines 59 and 60 and the direction of the force exerted by the springs 36 is represented by the broken line 61, which as can be seen is situated between the lines 59 and 60. This ensures a stable operation and a correct cutting action of the two shaving sections.

Figure 3:
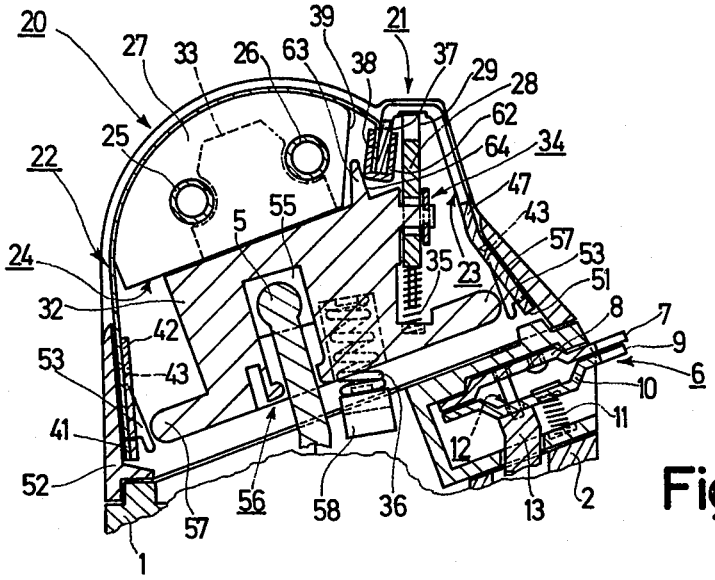
FIG. 3 shows a modification to the embodiment shown in FIG. 1, in which the cutter unit includes a guide surface which co-operates with the head-member unit.

In the embodiment shown in FIG. 3 the connection between the side wall 37 of the trough-shaped part 23 forming the head member of the comb-shaving section 21 and the inclined edge portion 38 of the shear foil 23 forming the head member of the shear-shaving section 20 is of a different type. Here this connection is obtained by means of a U-shaped clip 62, which retains the edge portion 38 and the side wall 37. By suitably compressing the two limbs of the U-shaped clip 62 a very stable and permanent connection is obtained. Furthermore, in this embodiment a projecting ridge 63 is formed on the support 23 of the cutter unit 24, 28, 32, which extends adjacent the inclined portion 39 formed on the cutter 24 of the shear-shaving section 20. The lateral surface of this ridge 63 which is remote from the cutter 24 forms a guide surface 64 which co-operates with the head-member unit 22, 23 at the location where the edge portion 38 of the shear foil 22 is connected to the side wall 37 of the trough-shaped part 23, in the present case by means of the U-shaped clip 62, in that these two parts are in sliding engagement with one another when the cutter unit 34, 28, 32 is reciprocated. This provides an additional guidance for the cutter unit, and thus for the cutters 24 and 28 of the two shaving sections 20, 21, close to the head-member unit 22, 23, which has a very favourable effect on the cutting performance of the shaving sections 20, 21. In principle, it is also possible to provide a guidance for the cutter unit 24, 28, 32 at this location of the head-member unit 22, 23, only, in which case the guide formed by the ridges 57 on the cutter unit and co-operating with the projecting lugs 53 on the shaving-head frame 52 may be dispensed with. The ridges 57 may then be shorter and merely serve to prevent the cutter unit from being shifted. Furthermore, it is alternatively possible to use the inclined portion 39 on the cutter 24 of the shear section 20 directly as a guide surface on the cutter unit.

The embodiment shown in FIG. 4 again comprises a shear-shaving section 20, which now at both sides adjoins a comb-shaving section 21. Again a head-member unit is formed, which now comprises a shear foil 22 and the two trough-shaped parts 23 forming the head members of the comb-shaving sections 21. The two trough-shaped parts 23 are permanently connected to the shear foil 22 in a way that the side wall 37 of each trough-shaped part 23 comprises an offset portion 65 to which the edge portion of the shear foil 22 which adjoins the working surface of said foil is attached by means of rivets 66. Again an edge portion 51 formed with mounting apertures 43 adjoins the other side wall 47 of the trough-shaped part 23. In this way the entire head-member unit 22, 23 is just as easy to handle as a simple shear foil and can be mounted in the projecting lugs 53 of the shaving-head frame 52 with the mounting apertures 43.

In the present embodiment the comb-shaving sections 21 are constructed so that each of them comprises two working surfaces for cutting longer hairs. One of the two working surfaces of each comb-shaving section 21 again forms an obtuse angle with the adjacent working surface of the shear foil 22, whilst the other working surface of the comb-shaving section is disposed near the side wall 47, which is remote from the shear foil, of the trough-shaped part 23 forming the head member of the comb-shaving section. Thus, the slits forming the hair-entry apertures in the trough-shaped part 23 extend into its side wall 47 and co-operate with a part of the cutter 28 associated with the relevant comb-shaving section.

In this embodiment the cutters of the shaving sections are also combined to form a cutter unit. This unit again comprises a support 32, which is now guided so as to be reciprocatingly slidable on the shaving-head frame 52 in groove-shaped guides 67 and 68 respectively. Here the cutter 24 of the shear section 20 comprises cutting lamellae 27, which are embedded in a supporting body 69. Two springs, of which spring 70 is visible in FIG. 4, are arranged between the cutter 24 and the support 32 which springs keep the cutter 24 urged against the shear foil 22. In order to ensure that the cutter 24 is driven by the support 32, when this support is reciprocated by the free end 5 of the swing lever, projections are formed on the support 69 of the cutter, of which projection 71 is visible in FIG. 4, which projections engage corresponding guide slots 72 in the support 32. The two cutters 28 of the comb-shaving sections 21 are arranged on ridges 73 and 74 which project from the support 32. The cutters 28 are formed by U-shaped sections, whose two limbs enclose the ridges 73 and 74 on the support 32. By means of springs 75, which act on the ridges 73 and 74 respectively and on lugs 76 which have been bent out of the cutters 28, the cutters 28 are urged into the trough-shaped parts 23 forming the head members of the comb-shaving sections 21, a rectilinear guidance being obtained by means of pin-slot connections 77. The pin-slot connections 77 also serve for driving the cutters 28 when the support 32 of the cutter unit is reciprocated. The cutters 28 have such a profile that, in the same way as the trough-shaped part 23 forming the head member of the comb-shaving section and the side wall 47 of this part, they comprise two portions which act as cutters. of which one portion is in snug engagement with the trough-shaped part 23 adjoining the shear-shaving section 20 with an obtuse angle and of which the other portion is in snug engagement with the side wall 47 of this part. At the location of these two portions the cutters 28 are also formed with continuous slits, thereby forming the cutting elements. In this way not only the working surfaces of the comb-shaving sections 21 which directly adjoin the shear foil 22 with an obtuse angle partake in cutting longer hairs, but also the portions formed by the side walls 47 of the trough-shaped parts 23, because hairs which penetrate into the slits which extend into a side wall 47 are severed directly by the relevant cutter 28. When the shear-shaving section 20 and a comb-shaving section 21 are used simultaneously not only the working surface of this comb-shaving section which directly adjoins the shear-shaving section with an obtuse angle is operative, but also its further working surface which is situated at the location of the side wall 47 of this comb-shaving section.

It will be appreciated that several modifications to the embodiments described above are possible without departing from the scope of the present invention. This applies in particular to the construction of the shear-shaving section and the comb-shaving section individually because, as is known, a multitude of possibilities exist in this respect, as will be apparent in particular from the two embodiments shown in FIGS. 1 and 4.

What is claimed is:

1. A dry-shaving apparatus which comprises a shear-shaving section having a first head member formed by an arcuate flexible shear foil providing a working surface, said shear-shaving section including a plurality of reciprocatingly drivable cutters co-operating with the flexible shear foil; a comb-shaving section having a second head member constructed as a rigid trough-shaped part fixedly and permanently connected to the flexible shear foil and provided with a working surface, said comb-shaving section including a reciprocatingly drivable rigid cutter co-operating with the rigid trough-shaped part; said first head member and said second head member together constituting a head-member unit; and a cutter unit co-operating with said head-member unit and including a reciprocatingly drivable support for supporting and driving the cutters of the respective shaving sections; the working surface of the comb-shaving section adjoining the working surface of the shear-shaving section and projecting laterally outwardly therefrom, the plane defined by the working surface of the comb-shaving section forming an obtuse angle with the plane tangent to the working surface of the shear-shaving section at the location where the two shaving sections adjoin each other; and the rigid cutter of the comb-shaving section being supported by the cutter unit support by means of at least one spring.

2. A dry-shaving apparatus according to claim 1, in which the portion of the flexible shear foil connected to the rigid trough-shaped part is inclined inwardly towards the cutter unit.

3. A dry-shaving apparatus according to claim 2, in which the inwardly inclined portion of the flexible shear foil extends adjacent to a similarly inclined edge formed on each cutter of the shear-shaving section.

4. A dry-shaving apparatus according to claim 2, in which the cutter unit includes a guide surface co-operating with the head-member unit at the location of the inwardly inclined portion of the flexible shear foil.

5. A dry-shaving apparatus according to claim 3, in which the hair-entry apertures formed in the head member of the comb-shaving section continue into the side wall of the rigid trough-shaped part remote from the flexible shear foil.

6. A dry-shaving apparatus according to claim 5, in which at least two adjacent apertures form one continuous aperture in said side wall.

7. A dry-shaving apparatus according to claim 1, in which the side wall of the rigid trough-shaped part remote from the flexible shear foil adjoins an apparatus housing edge portion inclined relative to said side wall and disposed substantially in the imaginary extension of the flexible shear foil.

8. A dry-shaving apparatus according to claim 1, in which the cutter unit support is urged towards the head-member unit by means of at least one spring, the direction of the force exerted on the cutter unit support by the spring being such that it extends between the longitudinal plane of symmetry of the shear-shaving section and the longitudinal plane of symmetry of the comb-shaving section.

* * * * *